US007993208B2

(12) United States Patent
Gordon

(10) Patent No.: US 7,993,208 B2
(45) Date of Patent: Aug. 9, 2011

(54) ROTATABLE TEETER TOTTER

(76) Inventor: Donald W. Gordon, Springville, UT (US)

( * ) Notice: Subject to any disclaimer, the term of this patent is extended or adjusted under 35 U.S.C. 154(b) by 666 days.

(21) Appl. No.: 12/077,058

(22) Filed: Mar. 13, 2008

(65) Prior Publication Data

US 2008/0234058 A1 Sep. 25, 2008

Related U.S. Application Data

(60) Provisional application No. 60/906,911, filed on Mar. 13, 2007.

(51) Int. Cl.
*A63G 1/32* (2006.01)
*A63G 1/00* (2006.01)

(52) U.S. Cl. ..... 472/5; 472/106

(58) Field of Classification Search ..... 472/4, 5, 472/106–115, 29, 32–34
See application file for complete search history.

(56) References Cited

U.S. PATENT DOCUMENTS

| | | | | | |
|---|---|---|---|---|---|
| 942,041 | A | | 11/1909 | Ott | |
| 1,502,746 | A | | 7/1924 | Roempke | |
| 1,552,841 | A | * | 9/1925 | Hector | 472/4 |
| 1,659,735 | A | | 2/1928 | Jamison | |
| 2,113,131 | A | * | 4/1938 | Eyerly | 472/39 |
| 2,190,795 | A | | 2/1940 | Meilleur | |
| 2,325,988 | A | * | 8/1943 | Thomas | 446/173 |
| 2,544,589 | A | * | 3/1951 | Cummings | 472/4 |
| 2,560,703 | A | | 7/1951 | Sebel | |
| 2,835,491 | A | | 5/1958 | Meyers | |
| 2,879,995 | A | * | 3/1959 | Harrison, III | 472/4 |
| 3,107,913 | A | * | 10/1963 | Rouse | 472/4 |
| 3,199,868 | A | * | 8/1965 | Motyka | 472/5 |
| 3,614,096 | A | * | 10/1971 | Ely | 472/4 |
| 3,675,919 | A | * | 7/1972 | Ewers | 472/113 |
| 3,840,226 | A | * | 10/1974 | Sharp | 472/4 |
| 4,226,411 | A | * | 10/1980 | Manus | 472/110 |
| 4,671,506 | A | | 6/1987 | Sutherland | |
| 4,896,878 | A | | 1/1990 | Greenwood | |
| 4,982,949 | A | | 1/1991 | Ulferts | |
| 5,709,606 | A | | 1/1998 | Ehrman | |
| 6,319,135 | B1 | | 11/2001 | Monson | |
| D512,746 | S | | 12/2005 | Habing et al. | |
| D512,747 | S | | 12/2005 | Habing | |

FOREIGN PATENT DOCUMENTS

| | | |
|---|---|---|
| KR | 20-0002480 | 9/1964 |
| KR | 20-0240587 | 7/2001 |

* cited by examiner

*Primary Examiner* — Kien T Nguyen
(74) *Attorney, Agent, or Firm* — Thorpe North & Western LLP

(57) ABSTRACT

Play equipment that combines the movements of a teeter totter and a merry-go-round includes a support for suspending a riding assembly, a riding assembly upon which a rider is supported, such as upon which a rider sits or a rider hangs from, and a suspending means which suspends the riding assembly from the support for both rotational movement with respect to the support and up and down movement with respect to the support. The up and down movement may be achieved by pivotal movement or by swinging movement. The support of the invention may be adjustable to adjust the height of the riding assembly. When seats for the riders are provided, the seats may include restraining means, such as back and side rails to help keep the rider in the seat. The equipment can include a single beam providing a pair of oppositely extending arms as with a traditional teeter tooter, or can include additional beams or arms, such as four arms, to accommodate additional riders.

12 Claims, 13 Drawing Sheets

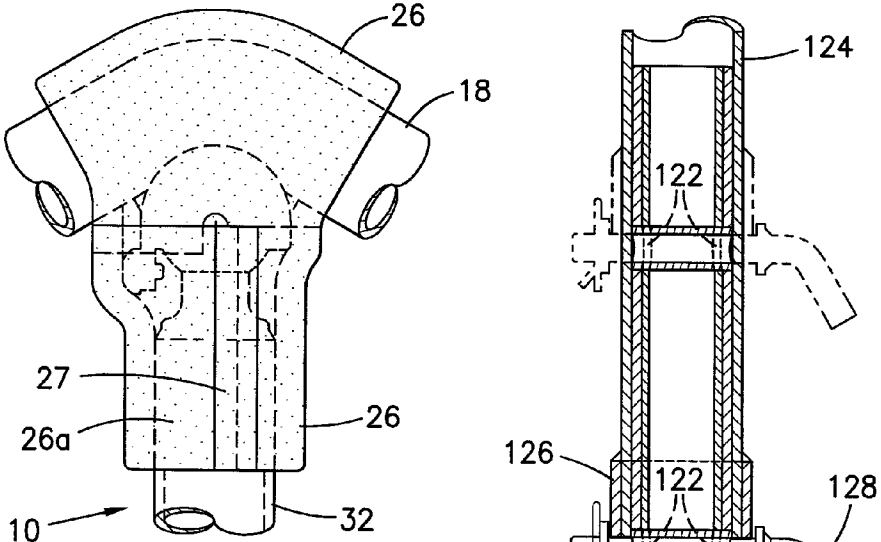
FIG. 12
FIG. 15
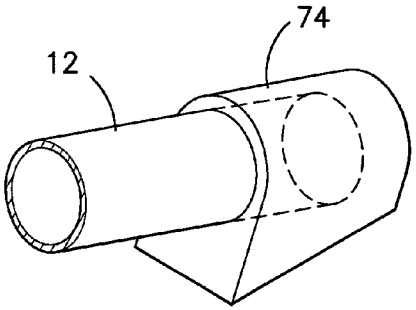
FIG. 13
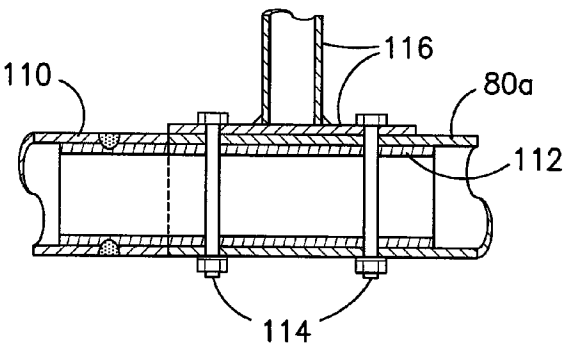
FIG. 17

ROTATABLE TEETER TOTTER

RELATED APPLICATION

This application claims the benefit of provisional Application Ser. No. 60/906,911, filed Mar. 13, 2007, and entitled "Rotatable Teeter Totter", hereby incorporated by reference.

BACKGROUND OF THE INVENTION

1. Field

The invention is in the field of play equipment and particularly teeter totters and merry-go-rounds or turntables.

2. State of the Art

Teeter Totters or seesaws have long been known. U.S. Design Pat. Nos. D512,746 and D512,747 show portable teeter totters having a supporting base that can be placed on any flat surface. Merry-go-rounds or turntables have also been long known and take various forms. Merry-go-rounds have been constructed as flat discs rotatably mounted on a central shaft which supports the merry-go-round and having handles so users can push the merry-go-round to get it spinning and then jump on to ride. Other merry-go-rounds have supports extending from a center shaft with seats at the ends of the supports on which users can sit. Such merry-go-rounds usually have movable handles which users move back and forth to cause rotation of the merry-go-round. Examples of these are shown in U.S. Pat. Nos. 2,560,703 and 4,982,949. Similar merry-go-rounds have been available with supports extending at an overhead level with swing type seats hanging from the supports so that a user sits in the swing seats as the merry-go-round rotates. Examples of this type of merry-go-round is shown in U.S. Pat. Nos. 5,709,606 and 6,319,135.

There have also been several embodiments of play equipment which combine the up and down movements of a teeter totter and the rotational movement of a merry-go-round. U.S. Pat. No. 1,659,735 shows a teeter totter device mounted by a ball joint to a vertical support post so that ends of the device can move up and down as a teeter totter and the device can also be rotated as a merry-go-round. Other embodiments of such a combination device are shown in U.S. Pat. Nos. 942,041, 1,502,746, 2,190,795, and 2,835,491.

While play equipment combining the movements of a teeter totter and a merry-go-round are known, there is always a need for new play equipment, particularly equipment that provides new play features, that is easy to assemble and set up, is portable, and/or can be used both outdoors and indoors.

SUMMARY OF THE INVENTION

According to the invention, play equipment that combines the movements of a teeter totter and a merry-go-round includes a support for suspending a riding assembly, a riding assembly upon which a user is supported, such as upon which a user sits, and a suspending means which suspends the riding assembly from the support for both rotational movement with respect to the support and up and down movement with respect to the support. The rotational movement is the merry-go-round movement, and the up and down movement provides the teeter totter movement where a user is moved up and down. The up and down movement may be achieved by pivotal movement or by swinging movement.

The support of the invention may be adjustable to adjust the height of the riding assembly. The support may take the form of a central post which suspends the riding assembly from the post, such as from the top of the post. The suspension means may include a ball at the top of the post and a ball receiving receptacle on the riding assembly, the ball and receptacle forming a ball joint as the suspension means. Alternately, the suspension means may include a turntable or other rotation device at the top of the post and a pivot mount on the rotation device to mount arms extending therefrom for up and down motion. The post can include telescoping pieces to adjust the height of the post or several posts or post pieces of differing lengths may be provided so the posts or post pieces of differing length may be substituted into the equipment to adjust the height of the post. Alternately, the support can take the form of a support frame which extends over the riding assembly and suspends the riding assembly beneath the top of the frame. The frame may take the form of two or more arches joined at the apex of the arches. A swivel attachment may suspend the riding assembly from the joined apexes of the frame.

The riding assembly may include seats for users to sit on. The seats can take a variety of forms such as the usual teeter totter seat or other type seat attached to the top of an arm at the end portion of the arm or attached to the end of the arm, or swing type seats that hang from the end portion of an arm. The seats can face inwardly, outwardly, forwardly, backwardly, or can swivel so the user can determine and change the facing direction during use. Further, the seats can be configured with sides and a back to help hold a rider in the seat during use of the play equipment, and can include bars along the back and sides of the seat, and can also include seat or other belts or straps to hold a rider in the seat during use of the device.

The equipment can include bias means, such as springs, to bias the riding assembly to desired biased positions. Further, the riding assembly may include stops to limit the swing of the assembly or to cushion the possible impact of the assembly on the ground. For example, resilient stops, such as spring mounted wheels, can be mounted to the ends of riding assembly to cushion impact of the riding assembly as the assembly approaches the supporting surface during teeter totter action, and, with a wheel, to allow easy rotational movement of the riding assembly when the end of the riding assembly would otherwise be impacting the supporting surface.

The support may includes legs so the equipment may be portable to be moved indoors or outdoors and be supported on any supporting surface, or the support may be received by and supported by structure, such as a receiving sleeve in the ground. Further, the support, particularly when in the form of a frame, may be permanently installed in the ground.

THE DRAWINGS

In the accompanying drawings, which show the best modes presently contemplated for carrying out the invention in actual practice:

FIG. 12 is a fragmentary elevation of the top of the vertical support such as shown in FIG. 1 showing a protective cover over the ball and socket joint;

FIG. 13 is a fragmentary perspective view of an end of a leg of the vertical support showing a different embodiment of leg foot;

FIG. 15 is a fragmentary vertical section taken on the line 15-15 of FIG. 14;

FIG. 17 is a fragmentary vertical section taken on the line 17-17 of FIG. 14;

DETAILED DESCRIPTION OF ILLUSTRATED EMBODIMENTS

Figure 1:
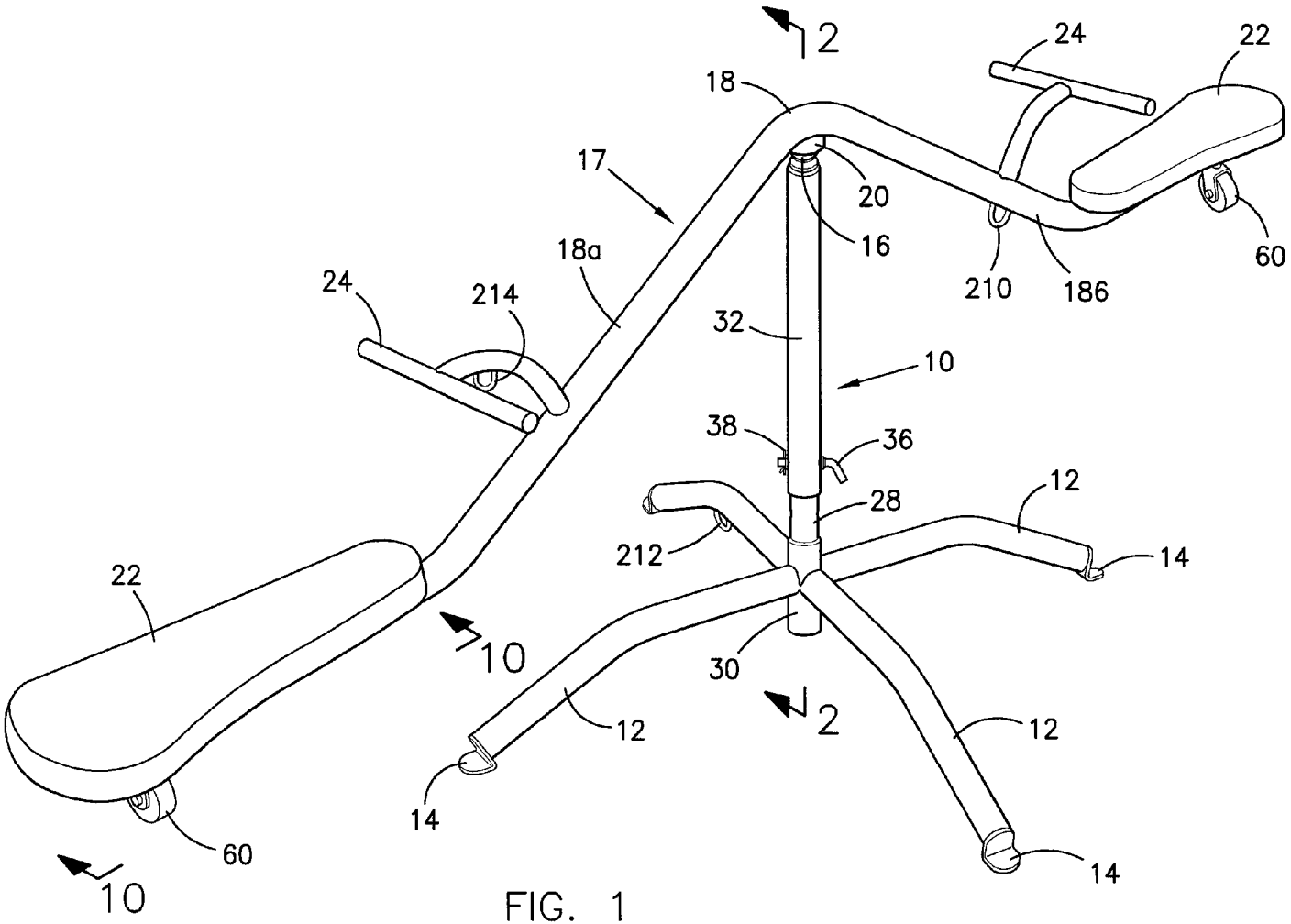
FIG. 1 is a perspective view of a two rider embodiment of the invention.
Figure 3:
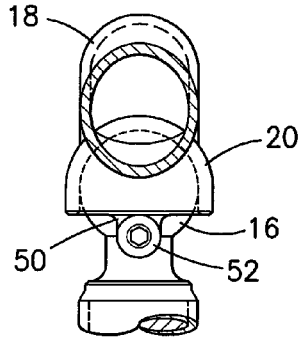
FIG. 3 is a fragmentary vertical section taken on the line 3-3 of FIG. 2.
Figure 4:
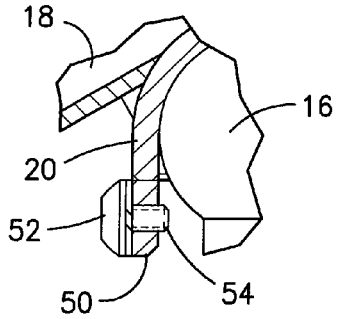
FIG. 4 is an enlarged view of the portion of the ball joint as shown at the top of FIG. 1 which includes the projection
Figure 14:
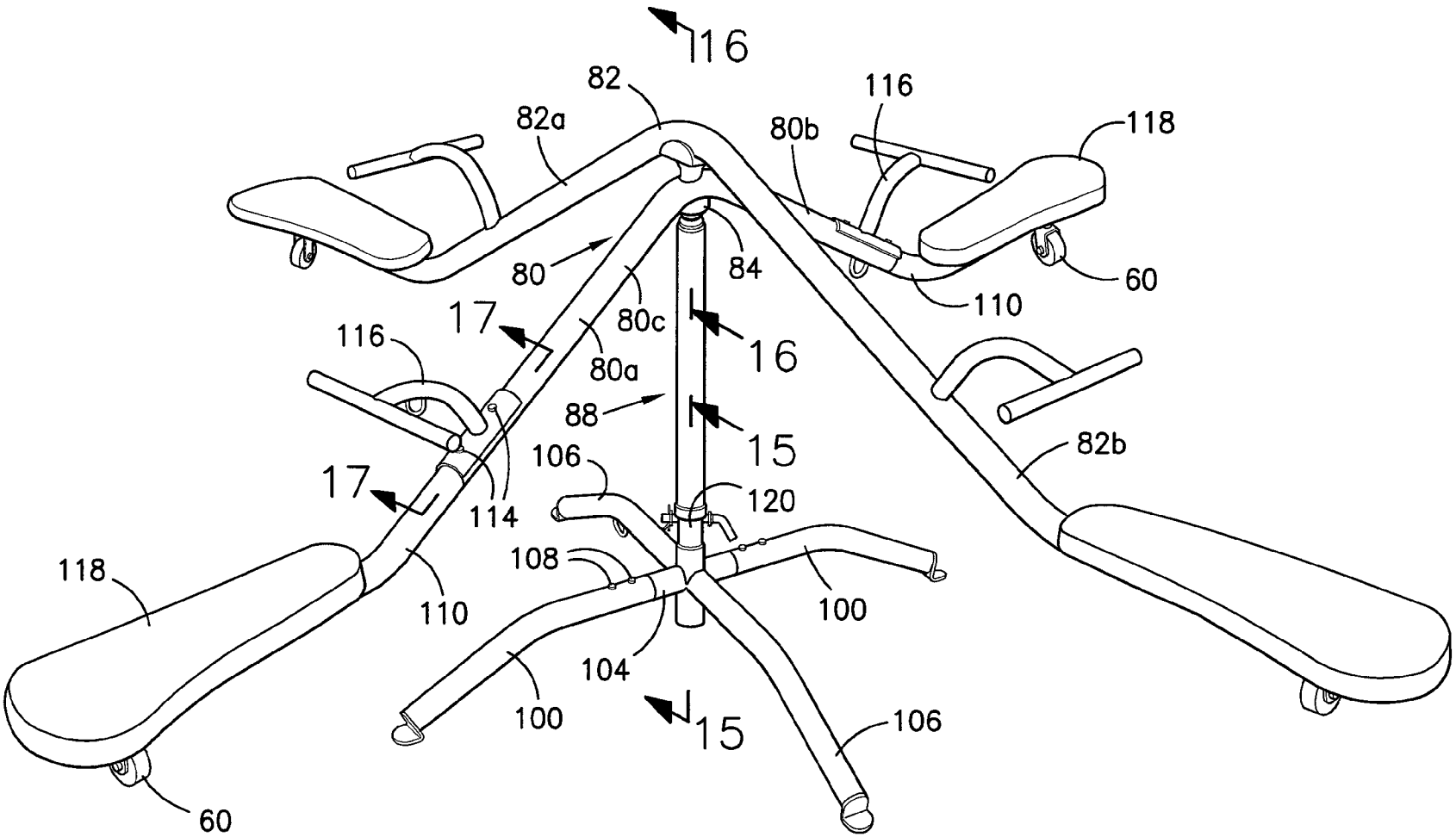
FIG. 14 is a perspective view of a four rider embodiment of the invention.
Figure 18:
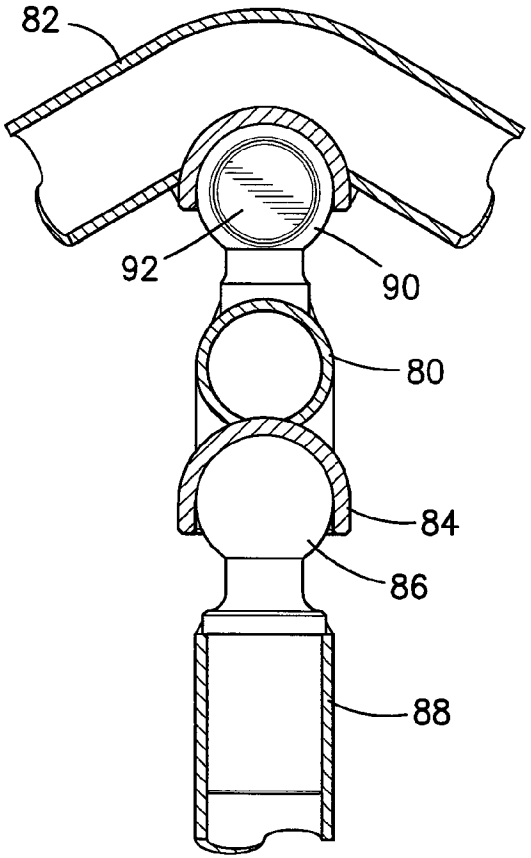
FIG. 18 is a fragmentary vertical section taken on the line 18-18 of FIG. 16.
Figure 16:
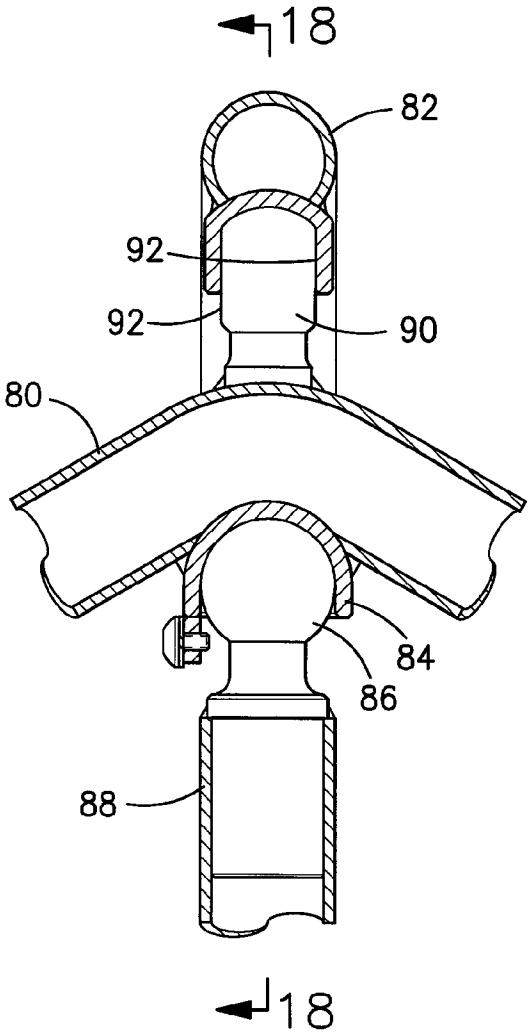
FIG. 16 is a fragmentary vertical section taken on the line 16-16 of FIG. 14.

A basic embodiment of the play equipment of the invention is shown in a two rider embodiment in FIG. 1 and a four rider embodiment in FIG. 14. Referring to the two rider embodiment of FIGS. 1-13, a central vertical support is made up of vertical post 10 with supporting legs 12, secured, such as by welding, to the lower end of post 10 and extending outwardly therefrom to support the post in vertical position on a supporting surface, such as an outdoor driveway, lawn, or other outdoor surface or an indoor surface, such as a floor surface. This embodiment shows four supporting legs 12, but three legs or more than four legs could be used. Feet 14 can be provided on the outer ends of the legs 12. Vertical post 10 has a ball 16, FIGS. 2-7, such as a trailer hitch ball, secured at the top of the post. A riding assembly 17, which in this embodiment includes a beam in the form of a length of metal tubing 18, has a ball socket 20 secured, such as by welding, to its center. The riding assembly is placed in relation to the support post 10 so that the ball socket 20 fits over ball 16. Ball 16 and ball socket 20 form a means for suspending the riding assembly from the support. Ball socket 20 secured to tubing 18 suspends tubing 18 from the top of support post 10 and forms the location along the tubing 18 where the riding assembly is suspended. Tubing 18 then forms a pair of oppositely extending arms, 18*a* and 18*b*, that extend from the suspension location of the riding assembly in opposite directions from the suspension location. With ball 16 and ball socket 20 suspending tubing 18 from the top of the post 10, tubing 18, and therefore the riding assembly, which is suspended from post 10 by tubing 18, is free to rotate with respect to the post in the manner of a merry-go-round or turntable and to pivot or tilt so that the ends of tubing 18, and thus the ends of the riding assembly, move up and down in the manner of a teeter totter.

Figure 5:
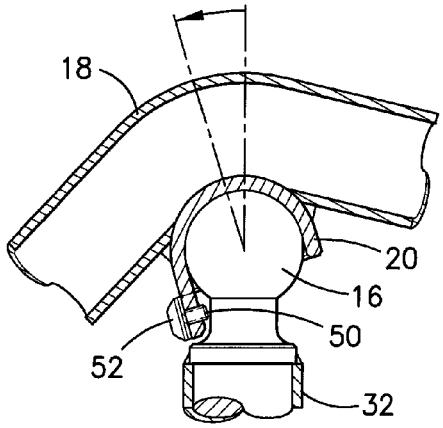
FIG. 5 is a fragmentary vertical section showing the ball joint at the top of FIG. 2 with the riding arm tilted.
Figure 7:
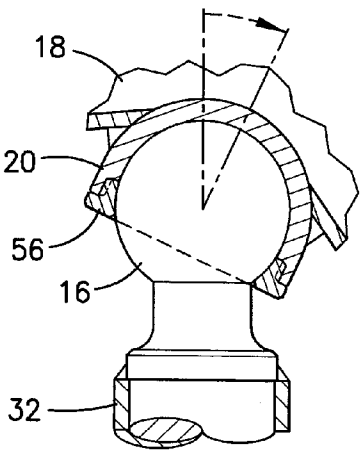
FIG. 7 is a fragmentary section similar to that of FIG. 6 showing the riding arm tilted.

The riding assembly also includes seats 22 at respective ends thereof for the riders or users to sit on, and handles 24 are spaced intermediate the ends in positions where riders sitting on the seats can hold onto the handles. Seats 22 shown are elongate and face inwardly toward the post 10 in the manner of the usual teeter totter seats. The illustrated seats 22 are relatively long so could accommodate two children riders sitting on each seat. FIG. 1 shows the ends of tubing 18 and seats 22 for the riders approximately level, and FIGS. 5 and 7 show the tilting of the tubing 18 on ball 20 (the ends of the tubing is not shown) so that one end of tubing 18 (the left end in FIG. 5 and the right end in FIG. 7) and a rider at that end would be in a down position near the supporting surface (not shown) and the opposite tubing end and a rider at that opposite end would be in an elevated or up position. For safety reasons, a cover 26, FIG. 12, can be provided over the ball and socket joint to reduce the chance of a person putting a hand in a position to be pinched or otherwise injured by movement of the ball joint. Various types and configurations of covers can be used, with the illustrated example cover 26 of FIG. 12 being made of a flat piece of a flexible material, such as a foam material, so that it can be placed over the tubing 18 with flap 26*a* then wrapped around the top portion of tubing 32 forming the top of the central support post 10, with the flap 26*a* secured to material 26 along connection 27 such as with hook and loop material. This secures the cover 26 in place over the ball joint.

Figure 2:
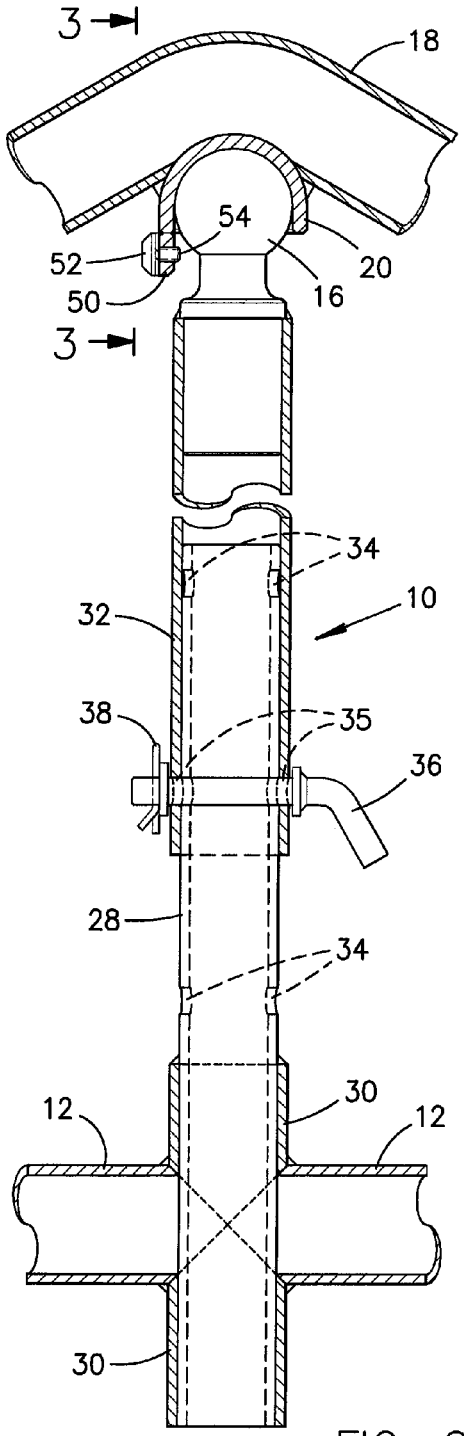
FIG. 2 is a fragmentary vertical section taken on the line 2-2 of FIG. 1.

While post 10 can be a single length of metal tubing with metal tubing legs 12 welded thereto to provide a fixed height to the support, it has been found advantageous to make the height of support post 10 adjustable so the device of the invention can be adjusted for different sizes of users. Thus, a short support post 10 to place the seats closer to the supporting surface would be preferred for small children with short legs while a taller support post 10 to place the seats higher above the support surface would be preferred for taller children or adults. FIGS. 1 and 2 show post 10 made up of telescoping pieces so the length of post 10, and thereby the height of the riding assembly and tubing 18 suspended from the top of post 10, can be adjusted. For this purpose, the embodiment of FIGS. 1 and 2 shows a base with a length of smaller diameter tubing 28 inserted into and secured, such as by welding, to lower tubing piece 30 to which legs 12 are secured, and which smaller diameter tubing 28 extends upwardly therefrom. Upper tubing piece 32 is slidingly telescoped onto tubing 28 and can slide up and down thereon. A series of hole sets 34, FIG. 2, are provided through tubing 28 at different heights along tubing 28 and a set of holes 35 are provided through upper tubing piece 32. To adjust the height of post 10, the holes in upper tubing piece 32 are aligned with a desired set of holes in tubing 28 and pin 36 is inserted through the aligned holes and secured in position by spring clip or pin 38.

Figure 8:
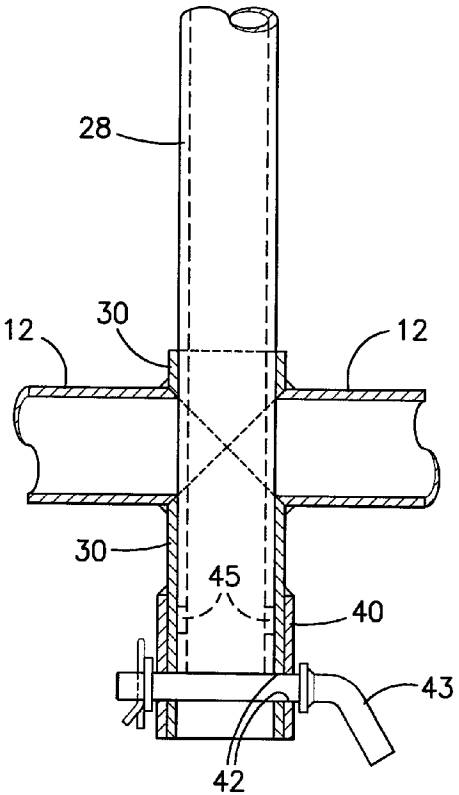
FIG. 8 is a fragmentary vertical section of the lower portion of the stand of FIGS. 1 and 2 showing a different embodiment of height adjustment with the stand in the high position.
Figure 9:
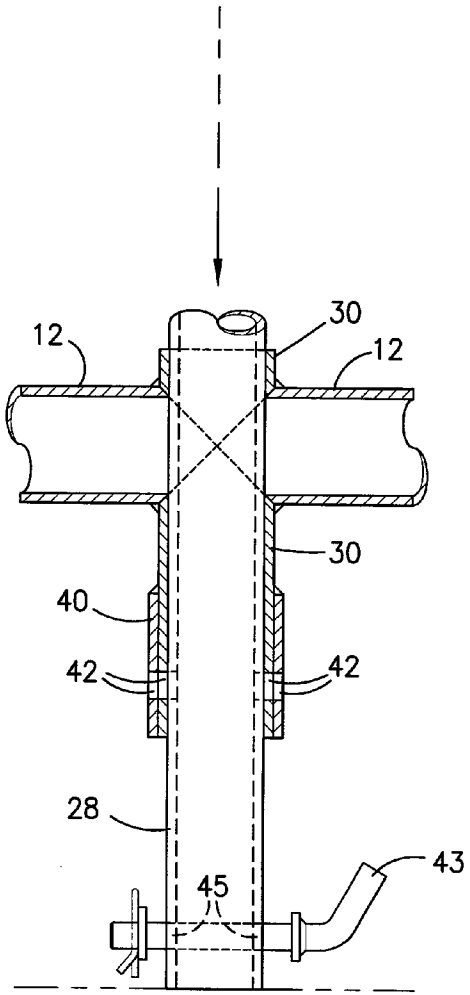
FIG. 9 is a fragmentary vertical section similar to that of FIG. 8, but with the height adjusted to the lowered position.

FIGS. 8 and 9 show an alternate embodiment of a height adjustable supporting post similar in construction to post 10 of FIGS. 1 and 2, with telescoping tubing components 28 and 30, but in this case, tubing 28 is secured to upper tubing piece 32 (not shown in FIGS. 8 and 9) rather than to lower tubing piece 30 and slides in lower tubing piece 30. An additional sleeve 40 is secured, such as by welding, to the bottom of lower tubing piece 30 under the leg attachments. Sleeve 40, along with tubing 30, has a set of holes 42, FIGS. 8 and 9, extending therethrough. This embodiment has two height adjustment settings as shown by the high position of FIG. 8, where pin 43 extends through hole set 42 and the bottom of tubing 28 rests on pin 43 as it extends through sleeve 40, and the lowered position shown in FIG. 9 where pin 43 has been removed from hole set 42 and the bottom of tubing 28 extends through sleeve 40 with either the bottom end of upper tubing piece 32 resting on the top end of lower tubing piece 30 (not shown), or, as shown, with the bottom end of tubing 28 resting on the supporting surface. Which of these situations occur depends upon the length of tubing 28. This construction lessens the tendency of pin 36 to elongate and distort the holes through tubing 28 and 32 in the construction of FIGS. 1 and 2 if the tubing used is relatively thin walled. Any indentations formed by pin 43 in the bottom of tubing 28 as it rests on pin 43 generally will not interfere with removal of the pin 43 since the tubing 28 and 34 can be lifted to release pin 43. Sleeve 40 can be made of thicker walled material or of stronger material than tubing 28, 30, and 32 to resist the elongation of holes 42. If desired, sleeve 40 can be made longer and can include more than one set of holes 42 so can offer several height adjustment settings. The legs could be made higher, if desired, to accommodate a longer sleeve. Of course, tubing 28 and 32 could be made of thicker walled material or reinforced in the area of the holes to resist elongation in the construction of FIGS. 1 and 2. With the embodiment of FIGS. 8 and 9, hole set 45 can be provided through tubing 28 to allow storage of pin 43 when not supporting tubing 28, as shown in FIG. 9. This prevents loss of pin 43.

Alternatively, or in addition to the limited adjustability shown for the telescoping post pieces, the height adjustability provided, or the amount of height adjustability provided, can be provided or increased by providing a plurality of post upper tubing pieces 32 in differing lengths. Each piece would have a ball at the top. With post upper tubing pieces 34, FIGS. 1 and 2, of different lengths, when the height of the post is desired to be adjusted or changed, upper tubing piece 34 present in the post is removed and a shorter upper tubing piece 34 is substituted in its place to provide a shorter post or a longer upper tubing piece 34 is substituted in its place to provide a higher post. Either the post construction of FIGS. 1 and 2 (different length upper post pieces 32 are provided) or FIGS. 8 and 9 (different length upper post pieces 32 with tubing pieces 28 extending from the lower end thereof are provided) can be used. If desired, the height adjustment shown for FIGS. 1 and 2 or FIGS. 8 and 9 can be used in conjunction with the substitution pieces to provide small height adjustments while the substitution of different length upper tubing pieces 34 can provide large height adjustments. For example, one upper tubing piece 32 can be provided with a length satisfactory to provide suspension of a riding assembly where the riders sit on top of the ends of the arms of the assembly and a second upper tubing piece 32 can be provided to raise the arms to a height above the riders' heads so that swing type seats can be used to hang down from the ends of the riding assembly arms.

It will generally be desirable to provide a locking means for securing the riding assembly to the ball so that in rough play with the device, the riding assembly will not separate from the suspending ball. FIGS. 1 and 3-5 show an arm 50 extending from ball socket 20 to the lower portion of the ball with a screw 52 threaded therethrough. When ball socket 20 is in position on ball 16, screw 52 is advanced through arm 50 so that screw end 54 extends far enough through arm 50 toward ball 16 that the ball socket 20 cannot be removed from ball 16. Further, as shown by FIG. 5, arm 50 can also act as a stop to limit the amount of tilting of the riding assembly. When used for this limit purpose also, arms 50 can be provided on opposite sides of ball socket 20 aligned with tubing 18.

Figure 6:
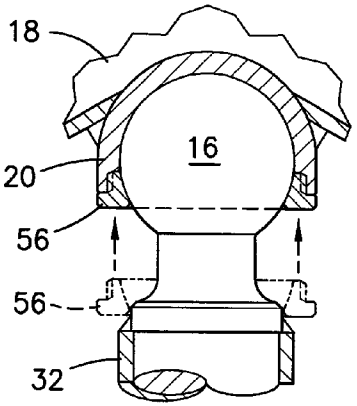
FIG. 6 is a fragmentary vertical section showing the ball joint at the top of FIG. 2 with a different embodiment for holding the riding arm to the ball.

An alternate locking arrangement is shown in FIGS. 6 and 7 where a lower ball socket locking piece 56 is threaded into the bottom of the socket 20 to reduce the size of the opening at the bottom of the socket and lock the socket onto the ball. As shown in FIG. 7, this can also serve as a stop to limit the amount of tilting allowed.

Figure 10:
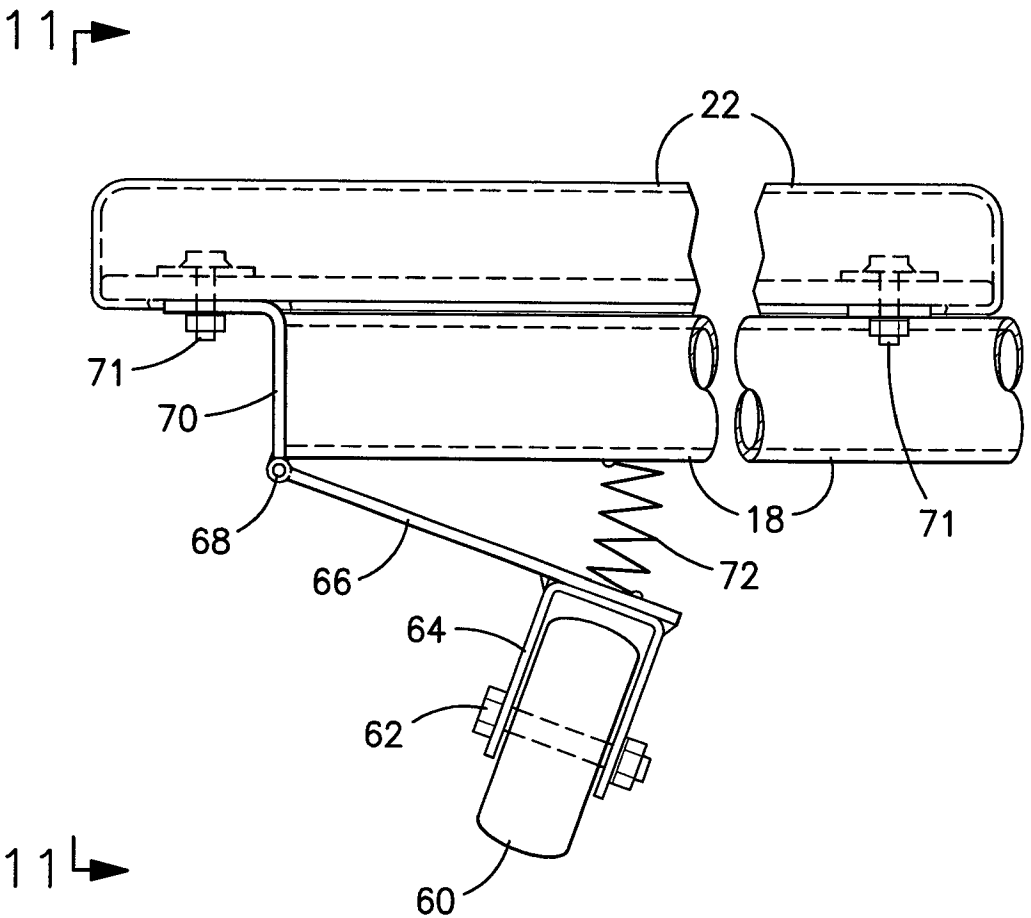
FIG. 10 is a fragmentary side elevation taken on the line 10-10 of FIG. 1.
Figure 11:
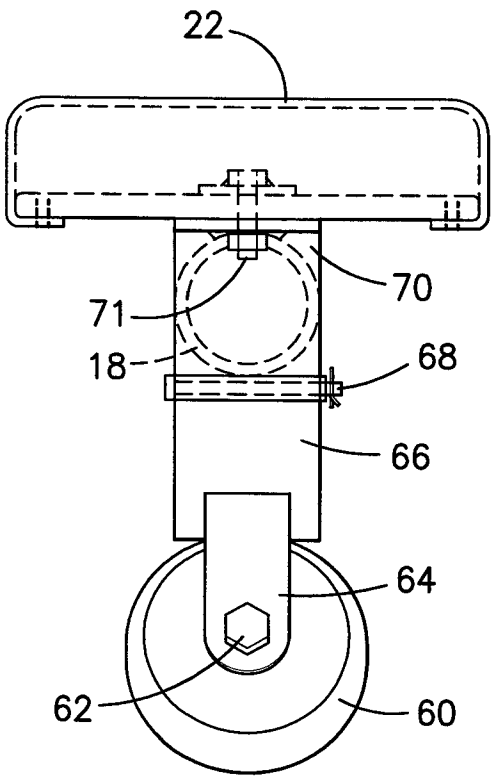
FIG. 11 is an end elevation take on the line 11-11 of FIG. 10.

It may also be desirable to provide a cushioning means at the ends of the riding assembly bar to cushion the possible impact of the end of the bar against the supporting surface when the riding assembly arm is tilted to the supporting surface. For this purpose, various shock absorbing devices can be used. FIGS. 10 and 11 show a spring biased wheel arrangement with a wheel 60 journaled for rotation on axle 62 in clevis 64 secured, such as by welding, to hinged plate 66 secured through hinge 68 to bracket 70 attached to the end of riding assembly arm 18 and seat 22, such as by bolt 71. Spring 72 biases plate 66 and wheel 60 to an extended position shown in FIGS. 10 and 11. When the end of the riding assembly arm 18 descends toward the supporting surface, and prior to impacting the supporting surface, wheel 60 will contact the supporting surface and spring 72 will start to compress to cushion the impact.

FIG. 13 shows an alternate embodiment of a foot, 74, for the ends of the base legs 12. Such a foot 74 will be preferred for indoor use and can be made of a soft or nonscratch material such as plastic or rubber type material.

While the embodiments shown in FIGS. 1-13 have a single beam 18 providing two arms 18*a* and 18*b* extending from the riding assembly suspension location, i.e., two oppositely extending arms extending from the location of the ball socket which suspends the riding assembly on the ball at the top of the vertical post, more than two arms could be provided. For example, as shown in FIG. 14, two beams 80 and 82 could be easily provided in the form of beams formed by lengths of metal tubing similar to that of tubing 18 of FIG. 1, to provide four arms 80*a*, 80*b*, 82*a*, and 82*b*. First beam 80 can be mounted with a ball socket 84 on ball 86 at the top of central vertical support vertical post 88 to provide a ball and socket mounting as shown and described for the embodiment of FIG. 1. A second ball 90 having opposite flat sides 92 is mounted on the top of beam 80 opposite the location of ball socket 84 on the underside of beam 80, and is received in a ball socket 94 having opposite flat sides 96 secured to the underside of beam 82. The flat sides 96 of ball socket 94 mate with the flat sides 92 of ball 90 to prevent relative rotation of beam 82 with respect to beam 80, while still allowing independent tilting teeter totter movement of beam 82. This construction forms a riding assembly with four arms, i.e., with two pairs of oppositely extending arms, extending from the suspension location, e.g., the location of the ball sockets. With four arms, the tubes or beams would normally be placed so that the arms would extend at ninety degree angles to one another, although other orientations could be used.

Various other mounting arrangements can be used to mount multiple beams or arms to provide a riding assembly for more than two riders. For example, a normal ball and socket joint without flat sides can be used for the upper beam 82 with various stop arrangements provided extending from either beam 80 or beam 82, or both, to prevent rotation of the second length of tubing in relation to the first length of tubing so that both lengths of tubing rotate together, while still allowing independent up and down pivoting movement of the second length of tubing in relation to the first length of tubing. Any arrangement that allows the second set of oppositely extending arms to pivot up and down independently from the first set, but holds all arms so that they rotate together, is currently contemplated as most desirable. However, a rigid arrangement of more than two arms, such as four arms, can be used, or a pivot mounting for an upper set of arms can be mounted on the lower set of arms to rotate with the lower set and allow independent up down movement of the upper set. Another example of a mounting to allow independent up and down pivoting motion of additional sets of arms is a turntable arrangement at the top of the vertical post which would freely rotate with respect to the vertical post, either with or without ball bearings. Two or more separate pivot connections for the two or more sets of oppositely extending arms are secured to the turntable to turn together with the turntable. In such arrangement, one pivot connection can be spaced upwardly from the turntable to be above the other pivot connection. This would allow independent pivot mounting of each set of arms and independent up and down motion of each pair of oppositely extending arms while all arms rotate together with the turntable. It should be noted that in most cases where more than one set of oppositely extending arms can be mounted in the play equipment, the extra sets of arms can be removed and not used resulting in the equipment being usable with one or more sets of oppositely extending arms.

The play equipment of the invention can be designed for use with more than four arms or can be designed to use three arms. However, where an odd number of arms is used, pairs of oppositely extending arms cannot be formed from a single piece or beam extending through the riding assembly suspension location. Separate arm pieces secured to and extending from the riding assembly suspension location are necessary. In such instances a hub can be provided around the riding assembly suspension location and the arms can be mounted to extend from the hub.

To aid in collapsing the device of the invention for shipping and storage, the embodiment of FIG. 14 shows one pair of opposite legs 100, made in pieces to be assembled by telescoping leg pieces 100 over reduced diameter extensions 102, FIG. 15, secured to, such as by welding, and extending from central base 104 from which legs 106 extend. Leg pieces 100 are secured to extensions 102 by bolts 108. This makes the unitized leg assembly made up of central base 104 and legs 106 substantially an elongate rather than X-shape piece which would take up a square space in packing, shipping, and storage. If desired, legs 106 could also be made in pieces. Also, the riding assembly is made up of several pieces. Thus, a pair of riding assembly arm end pieces 110 have reduced diameter extensions 112, FIG. 17, secured to, such as by welding, and extending from an end thereof to fit into the opposite ends of center riding assembly piece 80*c*. Arm end pieces 110 are secured in the ends of center riding assembly piece 80*c* by bolts 114 which also hold removable handle assemblies 116 in place. Seats 118 are secured to the arm end pieces 110 toward the end away from the center riding assembly piece 80*c*. While not shown in FIG. 14, when one beam of the riding assembly is made up of pieces as just described, the second beam, if a second beam is present, would usually be similarly assembled of pieces so could be disassembled for shipping and storage.

The device of FIG. 14 also shows a further embodiment of height adjustment for the vertical support post 88. Here, as in the embodiment of FIGS. 1 and 2, a length of smaller diameter tubing 120, FIG. 5, is secured to, such as by welding, and extends upward from central base 104 and includes a series of hole sets 122 through tubing 120 at different heights along tubing 120. Upper tubing piece 124 is slidingly telescoped onto tubing 120 and can slide up and down thereon. A reinforcing sleeve 126 is secured to the lower end of upper tubing piece 124. To adjust the height of post 88, pin 128 is inserted through a desired hole set 122 in tubing 120 and upper tubing piece 124 is telescoped onto tubing 120 and slides along tubing 120 until the bottom of upper tubing piece 124 and reinforcing sleeve 126 rest on pin 128. The particular hole set 122 through which pin 128 is placed determines the height adjustment of post 88.

Figure 19:
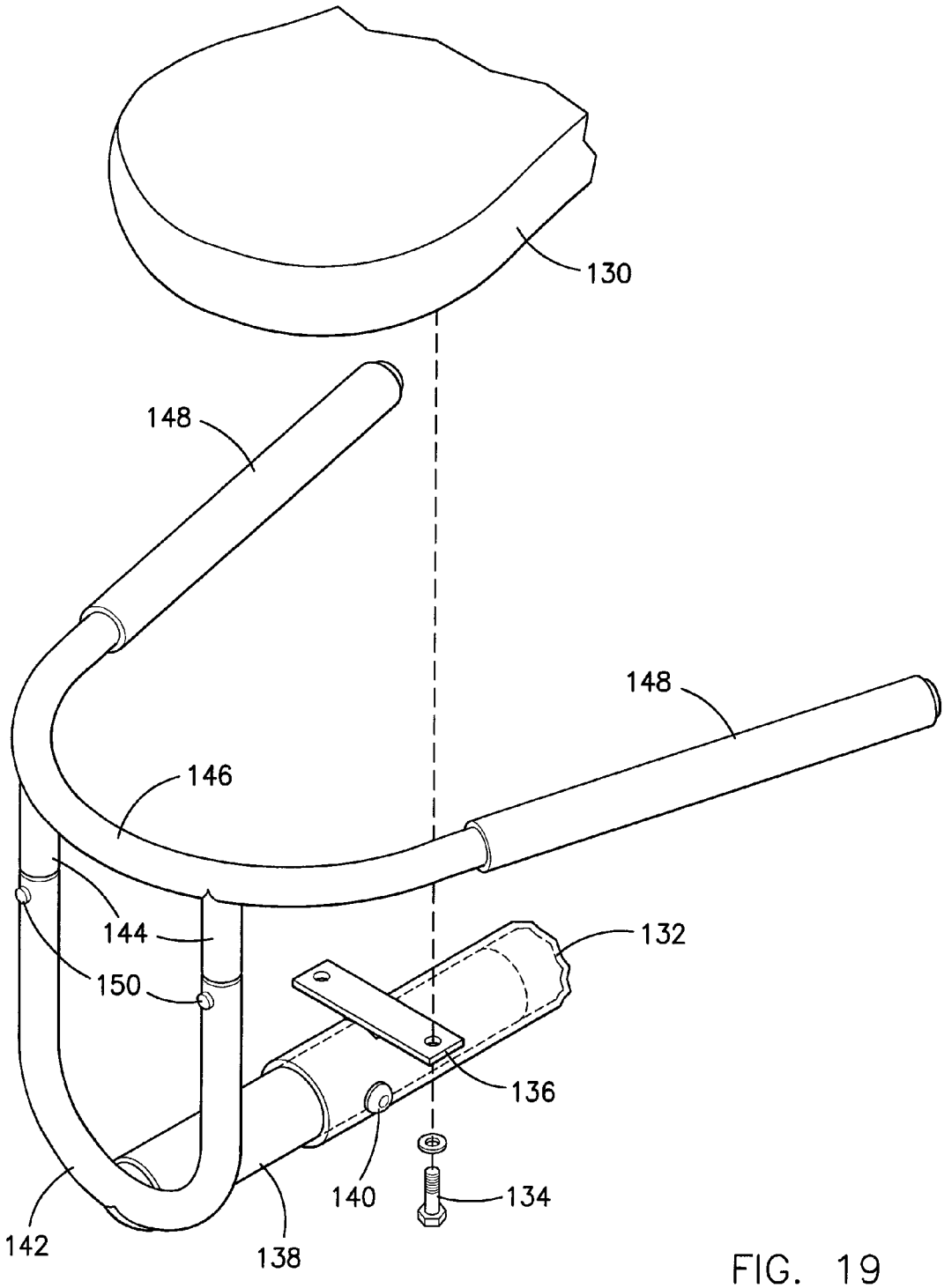
FIG. 19 is a perspective view of a retaining seat frame that can be used with the invention.
Figure 20:
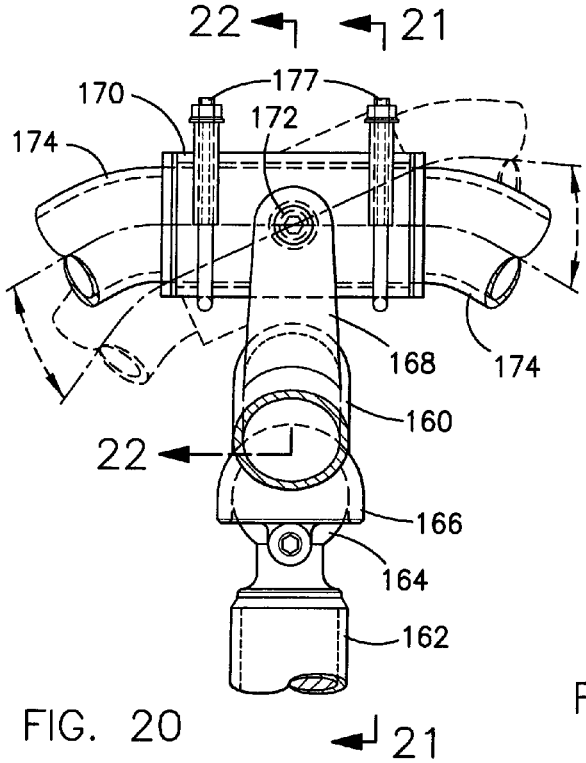
FIG. 20 is a fragmentary vertical elevation of the top of the vertical support showing a further embodiment of mounting two riding assembly beams.
Figure 21:
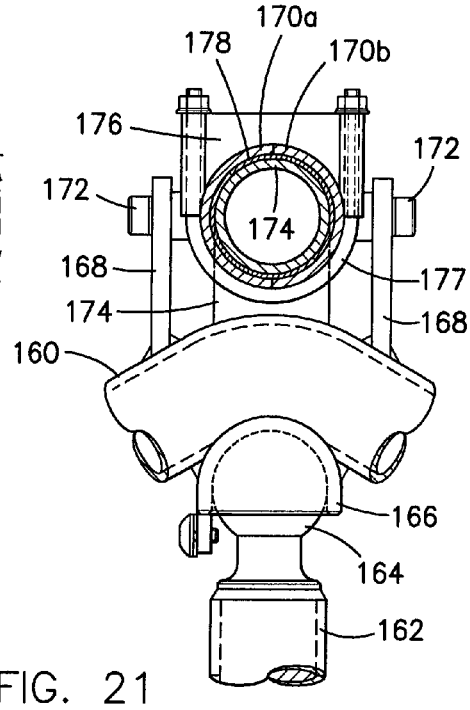
FIG. 21 is a fragmentary vertical elevation taken on the line 21-21 of FIG. 20.
Figure 22:
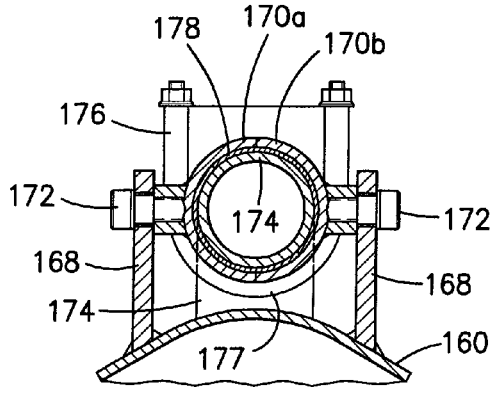
FIG. 22 is a fragmentary vertical section taken on the line 22-22 of FIG. 20.
Figure 23:
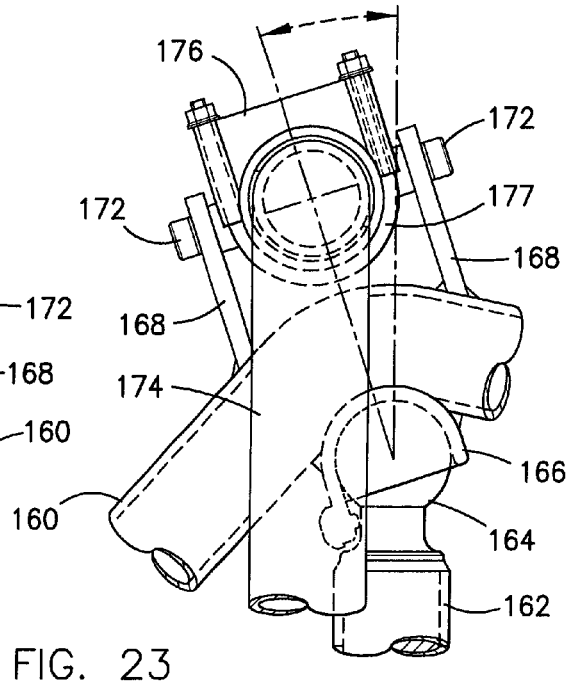
FIG. 23 is a fragmentary vertical elevation similar to that of FIG. 20 showing the riding assembly in a tilted position.

In many instances, it will be desirable to provide a safety seat for the device so that users are held more securely on the seat. One embodiment of such a seat is shown in FIG. 19, where a usual teeter totter seat 130 is secured to the end of arm 132 by screws 134 extending through bracket 136 secured to arm 132 such as by welding. A safety bar assembly is secured to the end of arm 132 by inserting tubing 138 in telescoping fashion into the end of tubing 132 and securing it in position with screw 140. U-shaped seat back 142 is secured, such as by welding to the end of tubing 138 and extends upwardly for telescoping attachment of legs 144 extending from U-shaped side bars 146 with cushioning 148. The telescoping ends of legs 144 are secured in seat back 142 by screws 150. This safety bar assembly provides a seat back and side bars to support a rider and hold a rider on seat 130 during use of the device.

Various other safety seat configurations can be used and various other configurations of seats can be used. Additionally, seats can be mounted in various orientations on the riding assembly so as to face inwardly, forwardly, backwardly, or outwardly. Seats can also take various decorative forms such as animal shapes, vehicle shapes, or other shapes. Where, as shown in FIG. 19, the safety bar assembly is secured to the arm by inserting tubing 138 into the end of the arm, a seat can be similarly mounted on tubing 138 and the tubing and the end of the arm can be configured to be joined in a certain number of predetermined orientations.

FIGS. 20-23 show an alternate mounting arrangement for the upper beam of a four arm embodiment of the invention such as shown in FIG. 14. The attachment of first beam 160 to support post 162 is through a ball and socket arrangement with ball 164 and socket 166 similarly to the arrangements already shown and described. Tabs 168 are secured, such as by welding to the top of beam 160 and extend upwardly therefrom in spaced configuration to form a clevis in which beam holder 170 is pivotally mounted by shoulder bolts 172 forming axles about which beam holder 170 and upper beam 174 can rotate. Beam 174 is removably held in beam holder 170 by saddle clamps 176 and U-bolts 177 which clamp upper beam 174 between beam holder halves 170*a* and 170*b*, FIGS. 21 and 22. Upper beam 174 can rotate in beam holder 170 and a split Teflon bearing 178 promotes such rotation.

Figure 24:
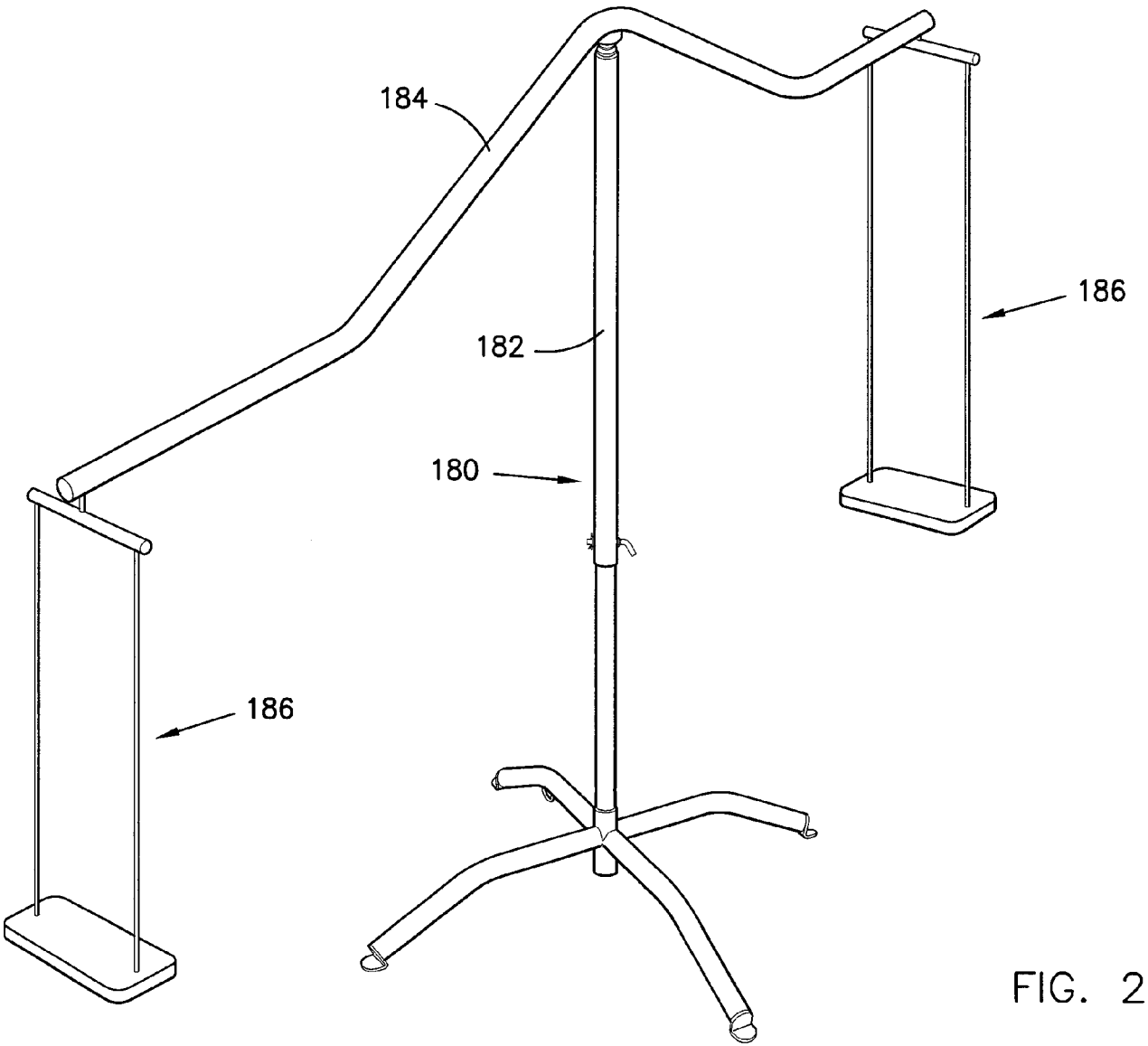
FIG. 24 is a perspective view of an embodiment of the invention wherein the riding assembly is supported above the heads of the riders.

FIG. 24 shows an embodiment of the invention where the central support post extends above the heads of the users or riders so that the riding assembly is supported above the heads of the riders expected to use the equipment. While FIG. 24 shows a two rider embodiment, a similar four rider or other number of rider embodiment could be provided. As shown, central vertical support post 180 has a longer piece of upper tubing 182 than the upper tubing piece 32 in the embodiment of FIG. 1. For the embodiment of FIG. 24, upper tubing piece 32 in FIG. 1 has been replaced by longer tubing piece 182 for height adjustment. The riding assembly beam 184 is supported above the heads of the riders and swing type seats 186 are secured to the ends of the beam 184 to hang down therefrom and support riders sitting therein. The swing type seats may be rotatably secured to the beam ends so they are free to rotate whereby the orientations of the seats can be selected by and changed by the riders so the riders can face inwardly, outwardly, forwardly, or rearwardly. Again, various types of seats can be hung from the beam ends, or a bar similar to a trapeze bar can be provided rather than a seat for either sitting or for grabbing and hanging from. The action of the play equipment device is still rotation in the manner of a merry go round and up and down movement in the manner of a teeter totter. Generally a height of the riding assembly of about eight feet is satisfactory for hanging swing type seats, although the desired height may vary. Also, the height of the riding assembly to be above the heads of the expected riders can vary with the expected riders. Thus, if the equipment is designed to be used by children, the expected riders for such equipment are children and the height of riding assembly can be lower than if the equipment is designed for use by adults so the expected riders are adults.

Figure 25:
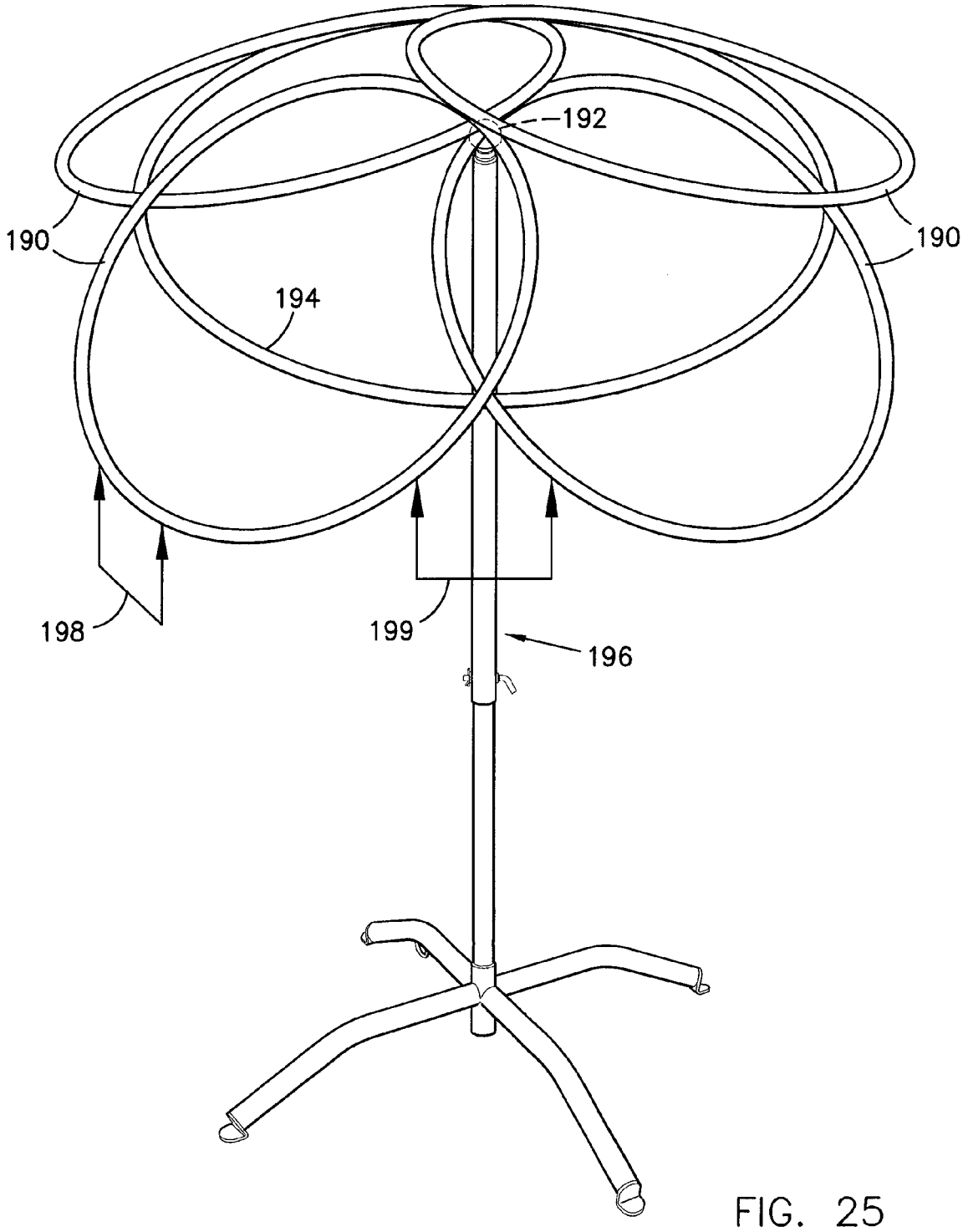
FIG. 25 is a perspective view of a further embodiment of the invention wherein the riding assembly is supported above the heads of the riders.

FIG. 25 shows a further embodiment of the invention where the central support post extends above the heads of the expected users or riders so that the riding assembly is supported above the heads of the riders. In this embodiment, a series of rings 190 (here shown as four rings) are secured together in a fixed configuration extending from a central hub 192, such as a ball socket, with a reinforcing ring 194 connecting the rings 190. It is preferred that the rings 190 slope downwardly from the central hub 192. This ring assembly is mounted at the top of support post 196 for rotation and up down movement as described for previously described embodiments. While hanging seats could be attached to the rings 190, this embodiment is shown without seats so that riders stand below the outer portions of the ring assembly and grab and hold onto the rings to hang down therefrom. Because the rings slope downwardly, the outer portion of the rings will extend closer to the supporting surface whereby shorter riders can more easily grab the outer portions of the rings as at 198 while taller riders can reach and grab inner portions of the rings as at 199. In testing of this embodiment, it has been found that riders obtain worthwhile shoulder and body exercise in hanging and riding this embodiment of the invention.

Figure 26:
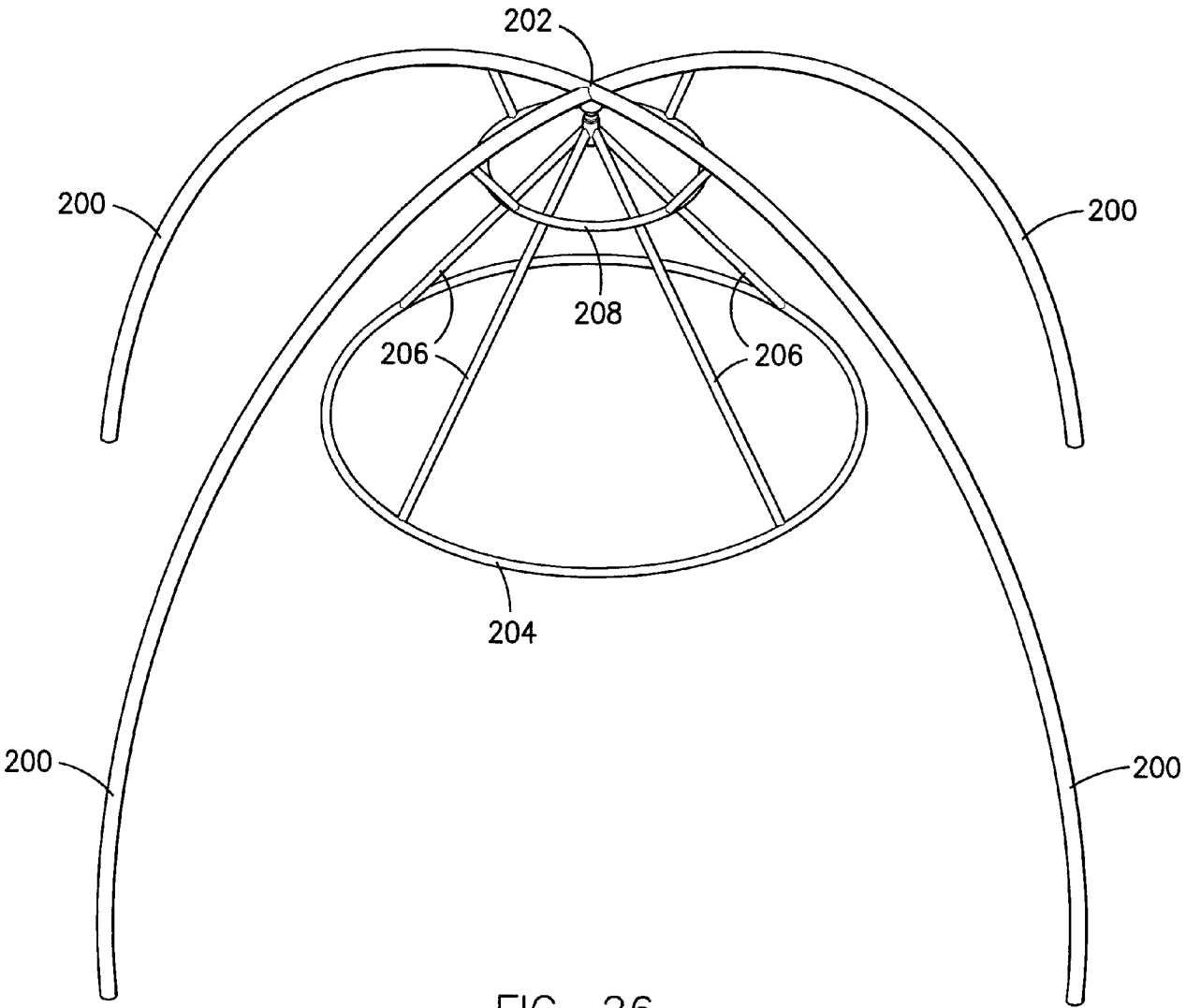
FIG. 26 is a perspective view of an embodiment of the invention showing a frame supporting the riding assembly.
Figure 27:
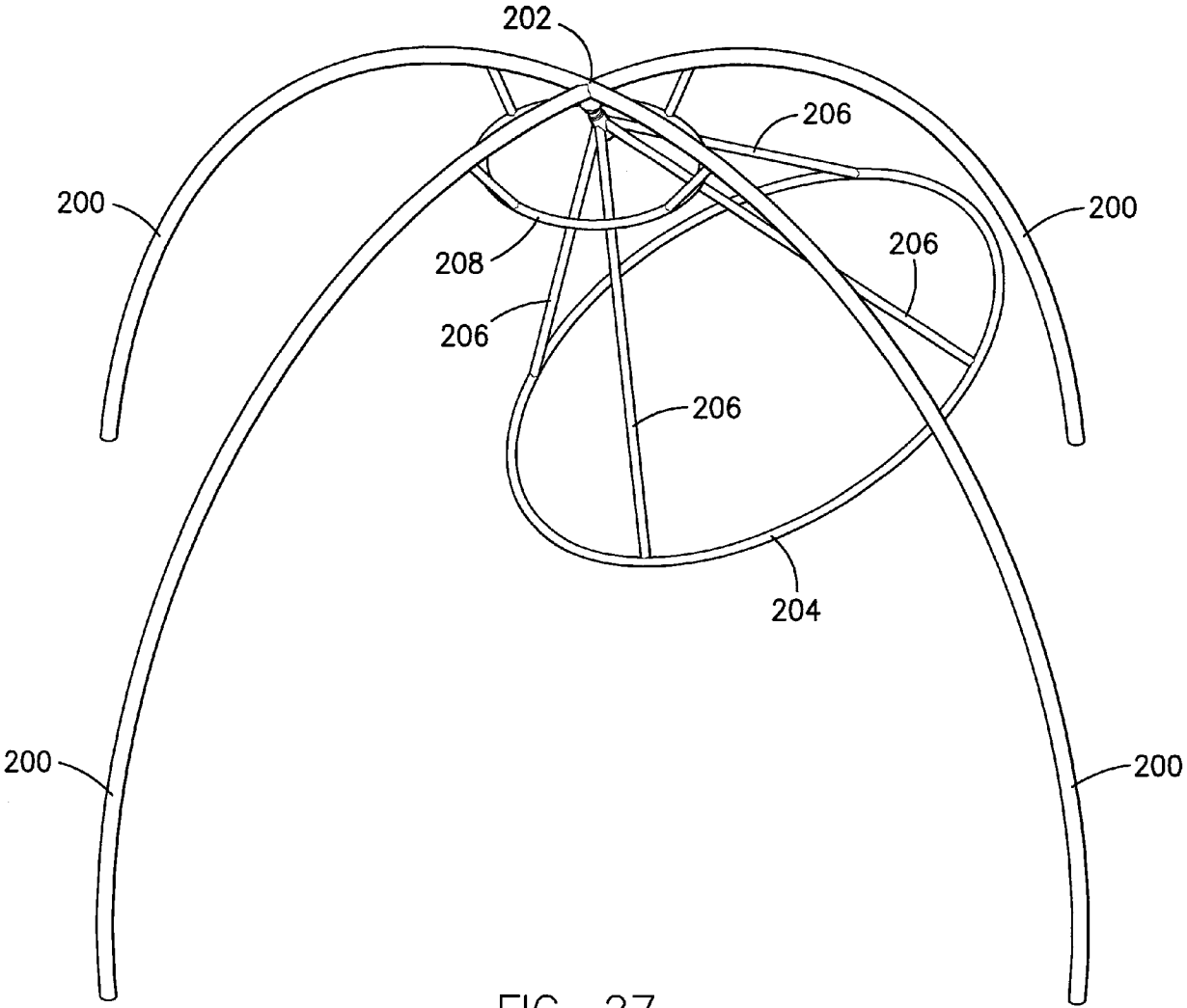
FIG. 27 is a perspective view similar to that of FIG. 26 showing the riding assembly in a tilted position.

FIGS. 26 and 27 show an embodiment of the invention wherein the riding assembly is supported by a frame rather than a vertical support post. The frame is formed from a pair of arcs 200 which come together and are secured together at the apex 202 of each arc, although the frame could take various shapes. The riding assembly is secured for rotation and up and down swinging motions to the apex 202 of the arcs and hangs down within the frame. The riding assembly includes a play ring 204 secured to the ends of arms 206. A safety ring 208 is mounted below the apex of the arcs to provide a stop to prevent excessive swinging motion that could result in the riding assembly or riders on the riding assembly hitting the frame. FIG. 26 shows the riding assembly in level position with the play ring 204 level, while FIG. 27 shows the riding assembly in tilted position with the play ring 204 tilted to one side. FIG. 27 shows the play ring 204 tilted to a maximum to the right so that an arm 206 abuts safety ring 208 to prevent further tilting of the ring to the right. Depending upon the height of play ring 208, riders can sit on or hang from the riding assembly play ring. With play ring 208 suspended at a height above the riders head, a rider can grab and hold onto the ring and hang down from the ring or seats, such as swing type seats, can be suspended from the ring. With a lower height of ring 208, the ring can have seats provided on the ring, or the ring can have a surface inside of the ring to support riders thereon.

If desired, springs or other elastic means such as bungee cords can be attached between various parts of the equipment, such as between the arms and a rotatable sleeve extending from the arms down along the supporting post and/or between the arms and a rotatable extension above the arms, either of which would rotate with the arms, to bias the arms to a biased position, such as a level position. As the arms move up or down in teeter totter action, the springs would stretch or compress and tend to prevent the ends of the arms from hitting the ground and provide a rebound from an up or down position back to the level position. Various other biasing means could be used. In addition, various cables or lengths of other material can be used to lock the device when not in use. Thus, referring to FIG. 1, a cable, such as a cable bicycle lock, can be attached between D-ring or eyelet 210 on arm 18*b* and D-ring or eyelet 212 on leg 12 when the arm 18*b* is aligned with the leg 12 which includes D-ring 121, so as to pull arm 18*b* downwardly and lock it in a downward position. This will lock the equipment so that it cannot be rotated or tilted up and down. D-ring 214 on handle assembly 24 could be used in place of D-ring 210 for locking the equipment. In addition, D-ring 214 on handle assembly 24 can be used to snap on a safety strap that would extend between D-ring 214 and a D-ring or other attachment site (not shown) on the back of seat 22 to surround a rider's body and help hold the rider on the seat.

Whereas the invention is here illustrated and described with reference to embodiments thereof presently contemplated as the best mode of carrying out the invention in actual practice, it is to be understood that various changes may be made in adapting the invention to different embodiments without departing from the broader inventive concepts disclosed herein and comprehended by the claims that follow.

The invention claimed is:

1. A combination teeter totter and merry-go-round, comprising:

a support for supporting a riding assembly;

a riding assembly having arms extending from a riding assembly suspension location; and suspension means suspending the riding assembly from the support for both rotational and up and down movement with respect to the support, the support being adjustable to selectively adjust the height at which the riding assembly is suspended from the support;

wherein the support includes a post having a top and extending upwardly from a supporting surface to suspend the riding assembly from the top of the post;

wherein the riding assembly has two pairs of oppositely extending arms to provide four arms extending at right angles from one another from the central riding assembly suspension location; and wherein the suspension means includes a rotatable member to allow rotation of the riding assembly with respect to the support and individual pivot mountings for each pair of opposite arms to allow independent up and down pivoting motion of each pair of opposite arms.

2. A combination teeter totter and merry-go-round according to claim 1, wherein each oppositely extending arm has an outer end, and additionally including a seat on each of the outer ends of the oppositely extending arms.

3. A combination teeter totter and merry-go-round according to claim 2, wherein the seat on each of the outer ends of the arms includes seat sides and a seat back, and additionally including rider retaining means along the back and sides of the seat.

4. A combination teeter totter and merry-go-round according to claim 3, wherein the rider retaining means includes a retaining bar along the back and sides of the seat.

5. A combination teeter totter and merry-go-round according to claim 1 wherein each pair of oppositely extending arms is formed as a single beam pivotally mounted intermediate its length at the riding assembly suspension location so that for each beam, one end of the beam goes up as the other end of the beam goes down to provide the up and down movement of the riding assembly.

6. A combination teeter totter and merry-go-round according to claim 5, wherein the opposite pairs of arms are provided by a first beam and a second beam, wherein the support has an upper end, and wherein the suspension means includes a ball at the upper end of the support and a ball receiving socket at the riding assembly suspension location for the first beam to mate with the ball at the top of the support, and means for mounting the second beam on the first beam for up down pivoting motion with respect to the first beam.

7. A combination teeter totter and merry-go-round according to claim 6, wherein the means for mounting the second beam on the first beam for up down pivoting motion with respect to the first beam includes a ball mounted on the first beam, a ball receiving socket at the riding assembly suspension location for the second beam to mate with the ball mounted on the first beam, and means to prevent rotation of the second beam with respect to the first beam.

8. A combination teeter totter and merry-go-round according to claim 7, wherein the means to prevent rotation of the second beam with respect to the first beam includes a flat on the ball mounted on the first beam, a mating flat in the ball receiving socket of the second beam.

9. A combination teeter totter and merry-go-round according to claim 6, wherein the means for mounting the second beam on the first beam for up down pivoting motion with respect to the first beam includes a pivot mounting for the second beam on the first beam.

10. A combination teeter totter and merry-go-round according to claim 1, wherein the post includes telescoping members which can be selectively secured in a plurality of telescoped positions relative to one another to selectively adjust the height at which the riding assembly is suspended from the support.

11. A combination teeter totter and merry-go-round according to claim 1, wherein the post includes a replaceable vertical member with a length which determines the height at which the riding assembly is suspended from the support, and which can be selectively replaced with another replaceable vertical member with a different length to selectively adjust the height at which the riding assembly is suspended from the support.

12. A combination teeter totter and merry-go-round according to claim 1, additionally including locking means operable by a user when desired to prevent rotation and up down movement of the riding assembly.

* * * * *